US006727787B2

(12) United States Patent
Worth et al.

(10) Patent No.: US 6,727,787 B2
(45) Date of Patent: Apr. 27, 2004

(54) METHOD AND DEVICE FOR ACHIEVING A HIGH-Q MICROWAVE RESONANT CAVITY

(75) Inventors: Thomas M. Worth, Somerville, MA (US); Kaplesh Kumar, Wellesley, MA (US)

(73) Assignee: The Charles Stark Draper Laboratory, Inc., Cambridge, MA (US)

( * ) Notice: Subject to any disclaimer, the term of this patent is extended or adjusted under 35 U.S.C. 154(b) by 0 days.

(21) Appl. No.: 10/036,859

(22) Filed: Dec. 21, 2001

(65) Prior Publication Data

US 2002/0113671 A1 Aug. 22, 2002

Related U.S. Application Data

(60) Provisional application No. 60/257,686, filed on Dec. 21, 2000.

(51) Int. Cl.[7] ..... H01P 7/00

(52) U.S. Cl. ..... 333/228; 333/234; 343/909; 029/600

(58) Field of Search ..... 333/204, 219, 333/238, 239, 246; 343/750 MS, 909; 29/600

(56) References Cited

U.S. PATENT DOCUMENTS

| | | | | | |
|---|---|---|---|---|---|
| 2,528,367 | A | * | 10/1950 | Iams | 333/239 |
| 2,800,634 | A | * | 7/1957 | Grieg et al. | 333/238 |
| 3,034,078 | A | * | 5/1962 | MCoubrey | 333/229 |
| 3,225,351 | A | * | 12/1965 | Chatelain et al. | 343/731 |
| 3,300,842 | A | * | 1/1967 | Weill | 29/600 |
| 4,249,300 | A | * | 2/1981 | Sirel | 29/600 |
| 4,578,658 | A | * | 3/1986 | Urien et al. | 333/227 |
| 4,800,350 | A | * | 1/1989 | Bridges et al. | 333/239 |
| 4,947,540 | A | * | 8/1990 | Komachi | 29/600 |
| 5,160,905 | A | * | 11/1992 | Hoang | 333/204 |
| 5,876,789 | A | * | 3/1999 | Nakada | 427/96 |

* cited by examiner

*Primary Examiner*—Benny Lee
(74) *Attorney, Agent, or Firm*—Testa, Hurwitz & Thibeault, LLP

(57) ABSTRACT

A device for manipulating microwave radiation includes a substrate that defines the shape of a surface for reflecting microwave radiation. The device also includes a metal fitting. The fitting conforms to the defined shape, and provides the surface that reflects microwave radiation.

21 Claims, 4 Drawing Sheets

METHOD AND DEVICE FOR ACHIEVING A HIGH-Q MICROWAVE RESONANT CAVITY

CROSS-REFERENCE TO RELATED CASE

This claims the benefit of and priority to U.S. Provisional Patent Application Serial No. 60/257,686, filed Dec. 21, 2000, the entirety of which is incorporated herein by reference.

TECHNICAL FIELD

The invention generally relates to microwave devices, and, more particularly, to high-Q microwave resonant cavities.

BACKGROUND INFORMATION

Devices that manipulate microwave radiation often include metallic components having surfaces that reflect the radiation. For example, microwave resonant cavities confine a microwave electromagnetic field by reflecting the field from the conductive walls of the cavity. Such cavities have a variety of applications, for example, filters, oscillators, frequency meters, tuned amplifiers and accelerometers.

The shape, dimensions and chemical composition of the metallic components of a device can have a substantial effect on the behavior the microwave radiation. For example, deformation of a resonant cavity, or perturbation of an object in the cavity, will perturb the electromagnetic waves in the cavity, and thus cause a change in the resonant frequency of the electromagnetic normal modes. Such effects can be beneficially utilized, for example, in accelerometers that are based on resonant cavities. Reflective losses, however, can limit the sensitivity of accelerometers.

Devices fabricated from highly pure metal can have surfaces that efficiently reflect microwave radiation, though pure metals will generally have poor thermomechanical stability. A stable metal alloy or ceramic can be used in conjunction with a metal coating; however, many prior art coating methods are limited in their ability to produce coatings of a desired purity, thickness or structural uniformity.

For example, electrochemical deposition (e.g., plating) can provide a metal coating on a conductive substrate. This deposition method can produce relatively thick layers, but the layers are generally impure and porous. Other deposition methods can provide a highly pure metal layer on conducting or non-conducting substrates. Such methods, however, are generally limited to the formation of very thin films, and are limited in their ability to provide uniform coatings, particularly when line-of-sight is unavailable for all surfaces of interest.

Resonant cavities have been manufactured from superconducting materials to obtain high-Q cavities for extremely sensitive accelerometers. Unfortunately, superconducting materials present manufacturing and operational difficulties, can be expensive, and are impractical for general applications.

SUMMARY OF THE INVENTION

The invention involves microwave devices that include highly efficient reflecting surfaces provided by conductive fittings bonded to substrates. The invention can provide, for example, high-Q microwave cavities. High-Q cavities in turn enable, for example, highly sensitive accelerometers.

More specifically, the invention involves devices, and methods for manufacturing devices, that have a preformed metal fitting bonded to a substrate. Forming a fitting prior to bonding the fitting to a substrate facilitates use of high-purity, low-resistivity metals. The substrate can thus be formed from any material that is structurally convenient for microwave device use, though it may have a poorly reflecting surface. For example, ceramic substrates can provide excellent rigidity and thermal stability, but are electrically insulating and thus do not reflect microwave radiation. Further, the invention enables the use of substrates having shapes that would make coating with high purity metals difficult with many prior art methods.

By bonding a sufficiently thin metal fitting to the substrate, the thermomechanical benefits of the substrate are obtained in conjunction with the efficient reflectivity of a low resistivity metal fitting. Reducing the resistivity of a fitting, for example, by increasing the metal purity, enhances the benefits of the invention by increasing the efficiency of reflection.

The invention thus solves problems found in prior art microwave devices. The invention provides fittings that can have a highly pure and highly uniform composition throughout their thickness. The fittings can be attached to a variety of substrate surfaces. An initial fitting thickness can be selected to accommodate manufacturing steps that occur prior to bonding, and the fitting can be thinned after bonding to a desired final thickness.

Accordingly, in a first aspect, the invention features a device for manipulating microwave radiation. The device includes a substrate that defines the shape of a surface for reflecting microwave radiation. The substrate can define the shape, for example, of a microwave resonant cavity or a component that, more generally, reflects microwave energy. The device also includes a metal fitting conforming to the defined shape. The metal fitting provides the surface that reflects microwave radiation.

The metal fitting is preferably formed of a high purity metal, such as high purity copper, silver or aluminum. Bulk samples of metal, from which fittings can be fashioned, may be fabricated, for example, from a wrought metal sample. The metal sample can be prepared by casting, and by cold or hot working the metal. The fitting may consist of a metal that is at least 99% pure.

The device can be any of a variety of devices that manipulate microwave energy. Such devices include, for example, a microwave resonant cavity, microwave waveguide or a microwave reflector.

The metal fitting preferably has a thickness of greater than 10 $\mu$m after completion of fabrication of the device. The thickness of the metal fitting is generally less than 500 $\mu$m, and preferably less than 100 $\mu$m. These thicknesses can limit the effect of the fitting on the size and shape of the device during thermal cycling.

In preferred embodiments, the substrate includes an insulator, such as a ceramic. A ceramic can provide a low coefficient of thermal expansion, and thus provide stable device dimensions during thermal cycling. The substrate can control the thermal behavior of the device dimensions when a relatively thin metal fitting is used.

The fitting can be bonded to the substrate via a variety of means. For example, a braze joint or an adhesive, for example, an epoxy, can be utilized. Alternatively, an interference fit, or compression fit, may be used to provide a bond via friction. Further, a combination of bonding means may be used.

The metal fitting can have a machined surface. The fitting may cover all or part of surfaces that are exposed to microwave energy.

In a second aspect, the invention features a method for making a device for manipulating microwave radiation. The method includes providing a substrate that defines a shape of a surface for reflecting microwave radiation. A metal fitting, which has a sufficient thickness to provide mechanical stability, is provided. The metal fitting is bonded to the substrate, and provides the surface that reflects microwave radiation.

The metal fitting can be thinned after bonding it to the surface, for example, via machining. Milling can also be used to shape the metal fitting prior to bonding it to the substrate. An interference bond can be obtained by cooling the metal fitting, placing the metal fitting adjacent to the substrate and causing the metal fitting to warm to an original temperature.

Similarly, a bond can be obtained by heating the substrate, placing the metal fitting adjacent to the substrate and causing the metal fitting to cool to an original (e.g., room) temperature.

Adhesives can be used to assist or provide bonding. Pressure may be applied to the metal fitting to obtain a thinner adhesive layer and/or to deform the metal fitting to conform to a surface of the substrate.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DESCRIPTION

The invention involves microwave devices having a surface that efficiently reflects microwave radiation. In various embodiments, metal fittings are formed and then attached to substrates. The fittings provide high quality surfaces for the reflection of microwaves, and enable the use of lower quality or non-reflecting materials in a substrate. In particular, high purity metal fittings can provide improved efficiency, in cooperation with a thermomechanically stable substrate. The invention thus provides thermomechanically stable devices that have efficient reflecting surfaces.

Figure 1:
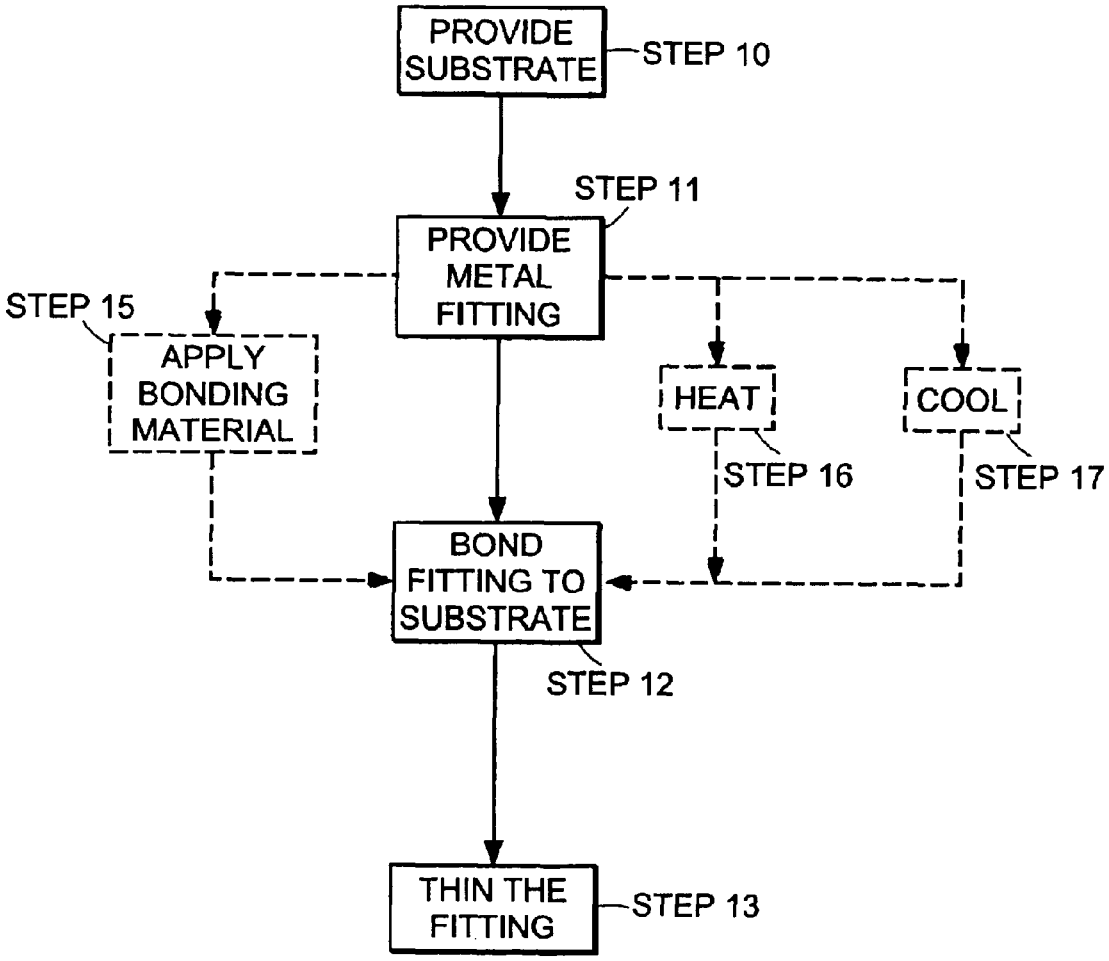
FIG. 1 is a flowchart that illustrates an embodiment of a method for making a device for manipulating microwave radiation.

FIG. 1 is a flowchart that illustrates an embodiment of a method for making a device for manipulating microwave radiation. A substrate is provided (Step 10), and a metal fitting is separately provided (Step 11). The fitting is bonded to the substrate (Step 12.)

Further, the fitting may be thinned after bonding (Step 13). A bonding material may be applied (Step 15) to assist the bonding of the fitting to the substrate. In some embodiments, the fitting or the substrate is heated (Step 16) to assist the bonding (Step 12), for example, via an interference fit that utilizes thermal expansion and subsequent contraction. Similarly, the fitting or substrate may be cooled (Step 17) prior to bringing the fitting and substrate into contact with each other.

Figure 2:
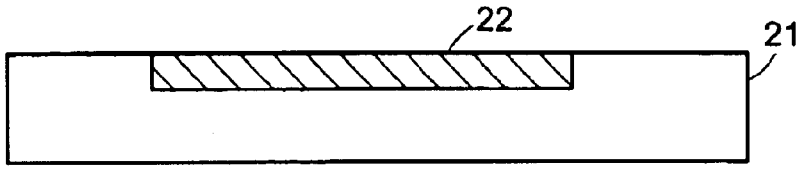
FIG. 2 is a cross-sectional view that illustrates an embodiment of a device for manipulating microwave radiation.

FIG. 2 illustrates an embodiment of a device for manipulating microwave radiation. The device includes a substrate 21 and a metal fitting 22. The substrate defines the shape of a surface that will reflect microwave radiation after the fitting is bonded the surface.

The metal fitting 22 can be fabricated from a variety of conductive materials. Preferably, the fitting is fabricated from a highly pure metal or metals. Such metals can be greater than 99.99% pure. Materials suitable for the fabrication of fittings include, for example, copper, silver, gold and aluminum. Highly purified copper material, for example, copper material that is commonly referred to as "oxygen-free" copper, is well suited to use in fittings. Use of highly pure, low resistivity metals can provide highly efficient, reflective surfaces. Such surfaces enable, for example, high-Q resonant cavities.

Aluminum, though of higher resistivity than copper or silver, can provide improved radiation hardness. For example, aluminum will reduce absorption in a flash x-ray environment due to its relatively low atomic number.

Use of metal fittings enables use of materials and device configurations that might otherwise make the realization of highly efficient surfaces difficult. Ceramic substrates can thus be employed for their excellent thermomechanical stability. More generally, materials having a relatively low coefficient of thermal expansion (CTE) can be used as substrates. For example, some steel/nickel alloys, for example, INVAR and SUPER-INVAR controlled expansion alloys, available from Carpenter Technology Corporation (Wyomissing, Pa.), provide a relatively low CTE, which is approximately 10% or less than that of standard carbon steels. Moreover, SUPER-INVAR alloys can provide a negative CTE.

The small CTE value of many ceramics, as well as specialized alloys, can thus enable production of a device having dimensions that are stable during thermal cycling. For example, low expansion glasses and or glass ceramics having a CTE of less than $1.0\times10^{-6}/°$ C. SUPER-INVAR alloy has a CTE of approximately $0.63\times10^{-6}/°$ C. In contrast, copper has a CTE value of approximately $17.0\times10^{-6}/°$ C. More generally, a substrate preferably has a coefficient of thermal expansion value of less than $5\times10^{-6}/°$ C. A metal fitting typically has a coefficient of thermal expansion value of greater than $10\times10^{-6}/°$ C.

Two suitable low expansion materials are ULE titanium silicate glass available from Corning Incorporated (Corning, N.Y.) and ZERODUR glass ceramic available from Shott Glass Technologies (Duryea, Pa.).

To provide good mechanical stability, or, more generally, to provide a device having a thermomechanical behavior that is dominated by the substrate, it is generally desirable to provide a substrate that is much thicker than an associated fitting. In some embodiments, a fitting thickness is approximately equal to or somewhat greater than the minimum thickness required to obtain maximum reflectivity from the fitting. For a non-conducting substrate, this minimum thickness is approximately 50 $\mu$m. For a conducting material, such as INVAR alloy, this minimum thickness is approximately 25 $\mu$m.

Handling of a very thin fitting can present mechanical difficulties. Hence, in some embodiments, a relatively thick fitting is fabricated and bonded to a substrate. After bonding, the fitting is thinned to a final thickness. The initial thickness can be chosen to provide mechanical stability during manufacturing of a device, for example, via a thickness of approximately 0.5 to 1.0 millimeter. A final thickness, can be chosen to provide maximum reflective efficiency as well as thermomechanical dominance by the substrate.

The final thickness can be obtained by thinning the fitting via any of many techniques. For example, the fitting can be machined, for example, with a lathe. Further, for example, grinding and polishing techniques can be used.

A very thin fitting can have additional benefits. For example, while a thicker layer attached to a CTE-mismatched substrate may deform or crack during thermal cycling, a very thin layer may be able to accommodate a substrate having a relatively small CTE. Thus the invention in part provides a device having a substrate and a metal fitting that have a compatible thermal behavior. That is, the substrate dominates the thermomechanical behavior of the device by imposing its response to temperature changes upon the fitting.

Figure 3:
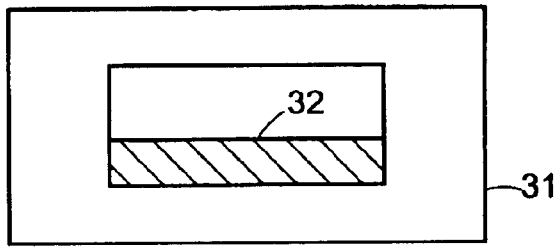
FIG. 3 is a cross-sectional view that illustrates an embodiment of a device for manipulating microwave radiation.

FIGS. 3–6 illustrate cross-sectional views of further embodiments of devices for manipulating microwave radiation. These embodiments illustrate a few of many possible device configurations. FIG. 3 illustrates an embodiment having a hollow, rectangular substrate 31 and a metal fitting 32 bonded to an interior wall of the substrate 31.

Figure 4:
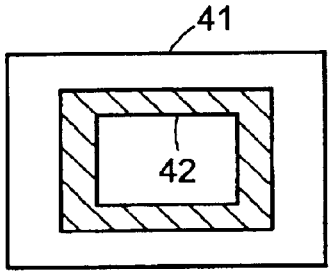
FIG. 4 is a cross-sectional view that illustrates an embodiment of a device for manipulating microwave radiation.
Figure 5:
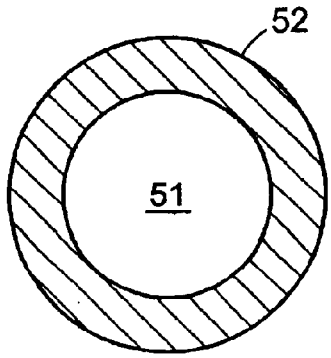
FIG. 5 is a cross-sectional view that illustrates an embodiment of a device for manipulating microwave radiation.

FIG. 4 illustrates an embodiment having a substrate 41 similar to the substrate 31 illustrated in FIG. 2, with a hollow, rectangular fitting 42, whose sides are adjacent to all of the interior walls of the substrate 41. FIG. 5 illustrates an embodiment having a rod-shaped substrate 51 with a tube-shaped fitting 52 bonded to the outside of the substrate 51.

Figure 6:
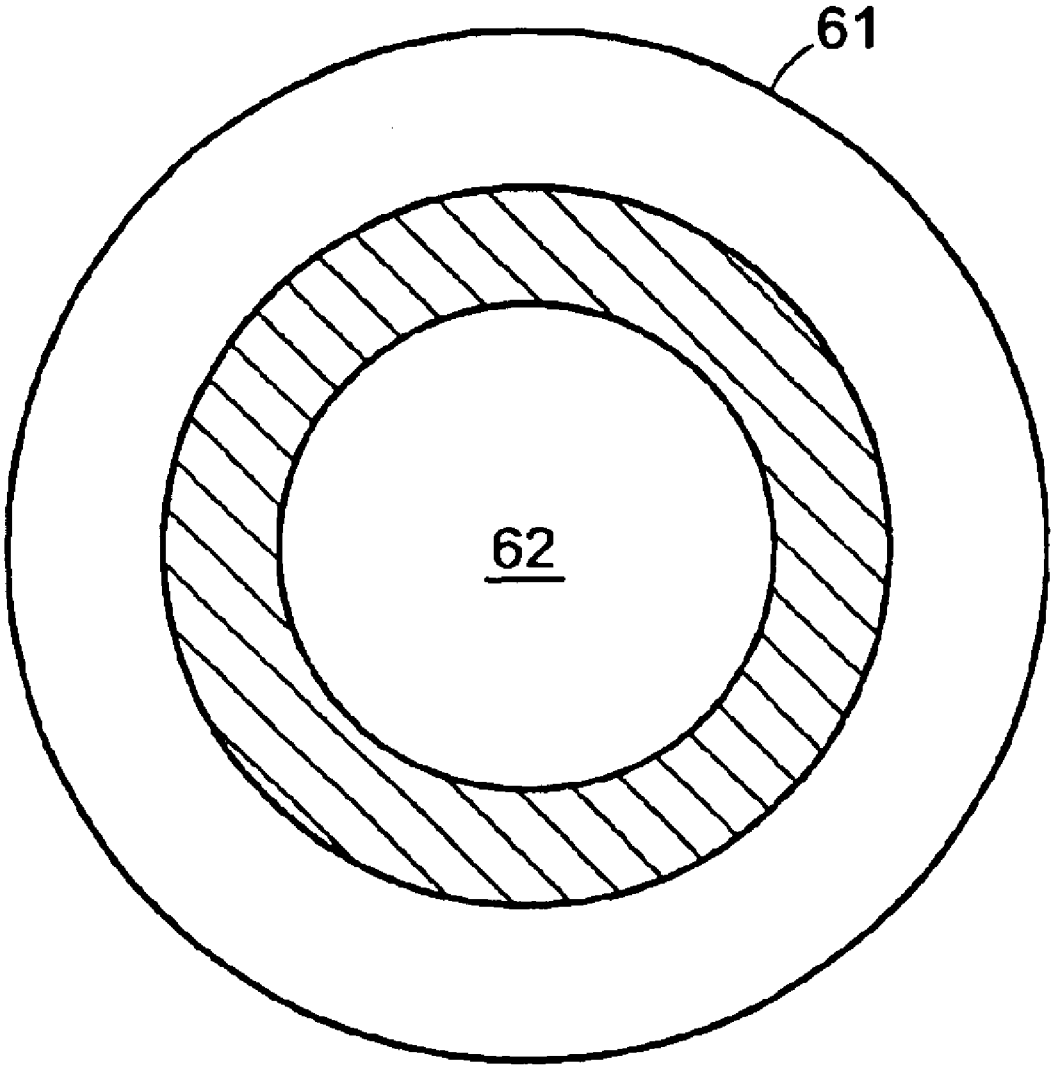
FIG. 6 is a cross-sectional view that illustrates an embodiment of a device for manipulating microwave radiation.

FIG. 6 illustrates a preferred embodiment for fabrication of a high-Q resonant cavity. A tube-shaped substrate 61 defines the shape of the cavity, and a tube-shaped fitting is bonded to the inside of the substrate 61.

A device, for example, the embodiment illustrated in FIG. 6, can be fabricated without any material assisting the bond between the substrate and the fitting. A secure bond can be provided via frictional forces between the substrate and the fitting. For example, a shrink fit, i.e., an interference fit, can provide such a bond.

For example, a tube-shaped metal fitting may be fabricated to a close tolerance, for example, 12 $\mu$m, to fit around a rod-shaped substrate (see, for example, FIG. 5.) The tube has an inner diameter that is smaller than the rod. The tube-shaped fitting is heated, expanding its diameter, and is then placed around the rod-shaped substrate. When the tube cools, it shrinks to snugly fit against the rod. In a similar manner, a tube-shaped substrate, having a non-zero CTE, can be heated (see, for example, FIG. 6) prior to placing a tube-shaped fitting inside the substrate tube.

For a bond provided entirely by an interference fit, the materials and dimensions should be selected to maintain the fit at all temperatures of operation of the device. Further, the material strengths and thicknesses should be considered when selecting a degree of interference; too great an interference can, for example, lead to cracking of components.

Epoxy may be placed between the substrate and the fitting to assist formation of a strong bond. In combination with the pressure that a shrink fit bond can provide, an extremely thin epoxy layer can be obtained. A thin epoxy layer further assists thermomechanical properties by limiting the effects of the epoxy during thermal cycling. Usually, the epoxy is applied to a substrate or a fitting that is not heated or cooled during formation of the interference fit.

Alternative embodiments utilize pressure, provided by thermal expansion or contraction respectively during heating or cooling, to bond a fitting to a substrate via an adhesive. For example, a tube-shaped fitting coated with adhesive is placed inside of a tube-shaped substrate, where the fitting has a greater CTE than the substrate. The fitting and substate are then heated, and the greater expansion of the fitting causes the outer diameter of the fitting to press against the inner diameter of the substrate. The adhesive then bonds the fitting to the substrate after cooling.

Similarly, a tube-shaped fitting can be placed around the outer diameter of a rod or tube-shaped substrate, with adhesive placed in between the fitting and substrate. The fitting and substrate are then cooled to cause the fitting's inner diameter to press against the substrate. The adhesive forms the bond, which remains after warming of the components.

A variety of materials are suitable for use as adhesives. For example, suitable adhesives include epoxies. Preferred epoxies include low-outgassing, room temperature curing materials. One such material is diglycidyl ether of bisphenol A (DGEBA) epoxy resin. Epoxy bonds typically have a thickness of approximately 10 to 15 $\mu$m. Hence, the dimensions of a substrate and a fitting can be chosen to accommodate an epoxy bond of this thickness. Use of relatively high pressures, however, can provide thinner adhesive layers, for example, 1 $\mu$m or less. Very high pressures in combination with low-viscosity epoxy can provide extremely thin bond layers of tens of nanometers thickness or less.

Generally, a choice of epoxy will depend on, for example, component materials, sensitivity to outgassing, and the degree of thermal sensitivity of the completed device. A low-curing-temperature epoxy, preferably curable at ambient temperature, is preferred when a large CTE difference exists between the substrate and the fitting. Use of an ultraviolet (UV) transparent substrate can permit use of a UV-curing epoxy. Generally, the chosen epoxy should bond well to the substrate and fitting materials.

Since epoxies generally have a relatively large CTE, in comparison to metals and ceramics, a thinner epoxy bond generally provides a more thermally, and thus more dimensionally, stable device. Further, a low-viscosity epoxy can ease the insertion of one component into a space having tight dimensional tolerances.

Some embodiments employ brazing to assist bonding. The type of braze joint, i.e., composition and thickness, depends on the materials used in the device. For example, a 50 $\mu$m thick Ag/Cu braze foil (72%/28%) can be used to braze a copper fitting to an INVAR alloy substrate. This braze foil material can provide good bonding to copper, as well as good bonding to the nickel constituent of the INVAR alloy.

The substrate and fitting dimensions can be chosen so that, at the brazing temperature of 750° C., the surfaces of the substrate and the fitting will come into contact. This can provide good contact between the fitting, a braze foil and the substrate, for example, in conjunction with the embodiment illustrated in FIG. 6.

With further reference to FIG. 6, in one embodiment, brazing commences by wrapping a piece of brazing foil along the inside wall of the substrate 61. A second piece of brazing foil is placed on a bottom face of a resonant cavity defined by the substrate, located normal to the viewing direction in FIG. 6. The fitting 62 is inserted into the substrate 61, and the assembly of components is placed in a brazing oven.

During brazing, pressure can be applied to the fitting 62 to assist the formation of the braze joint at the bottom face of the cavity. The completed braze joint will generally be subjected to mechanical stresses due to the varying CTE's of the different components. Thinning of the fitting can reduce these stresses.

Use of an insulating substrate can require metallization, i.e. application of a thin metal layer to a surface of the substrate, prior to brazing. Alternatively, an active brazing foil can be used. Such foils include, for example, Cr or Ti to assist in bonding to the oxide surface of a ceramic.

Braze joints can provide good mechanical integrity. Further, metallic braze alloys formed at the joint generally have lower CTE's than epoxies, thus improving the thermal stability of the device. A thinner braze foil generally enhances these benefits.

Figure 7A:
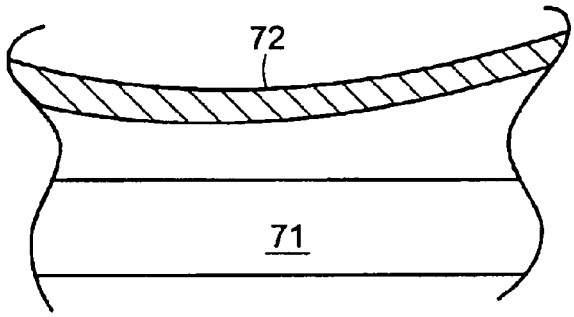
FIGS. 7A, 7B & 7C are cross-sectional views that illustrates an embodiment of a method of making a device.
Figure 7B:
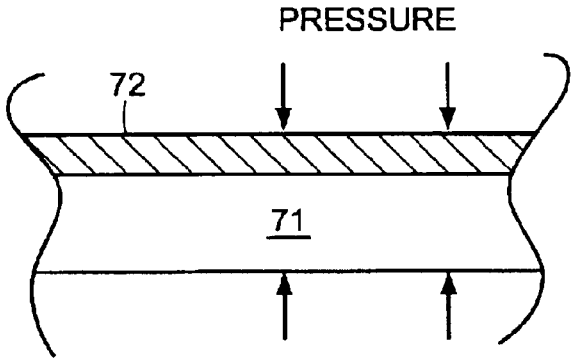
Figure 7C:
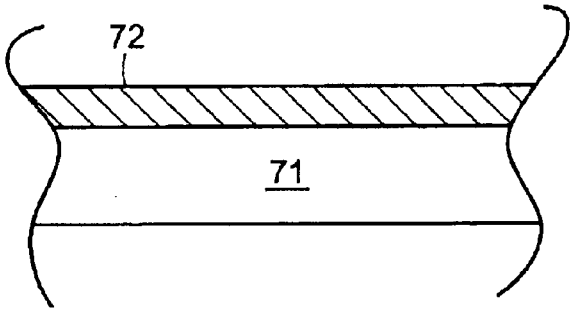
Figure 8:
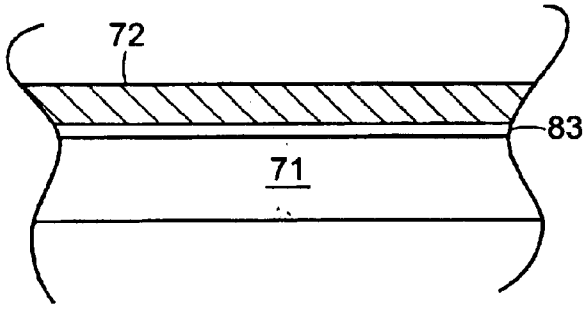
FIG. 8 illustrates an embodiment similar to that of FIG. 7, which also includes an adhesive layer.

Referring to FIGS. 7 and 8, some embodiments employ pressure during a bonding process, to cause a fitting to conform to a substrate via elastic and/or plastic deformation. If an adhesive is used in conjunction with the application of pressure, the applied pressure can improve adhesive coverage and/or provide a thinner adhesive layer.

FIGS. 7A, 7B & 7C illustrate an embodiment of a method of making a device. Portions of a substrate 71 and a fitting 72 prior to bonding are illustrated, as indicated at "A". Placing the fitting 72 adjacent to the substrate 71, and application of pressure, indicated at "B", causes the fitting 72 to conform to the surface of the substrate 71. After bonding and release of the pressure, indicated at "C", the fitting 72 remains conformal to the surface of the substrate 71.

FIG. 8 illustrates an embodiment similar to that illustrated in FIGS. 7A, 7B & 7C, with the further provision of an adhesive layer 83. The fitting 71 can be machined to fit loosely against the substrate, for example, with a clearance of approximately 25 to 50 $\mu$m. The fitting 71 can have a thickness of, for example, approximately 0.6 mm (0.025").

In one embodiment, pressure is applied via a cold isostatic press (CIP). After the substrate 71 and fitting 72 are placed in position, optionally with an adhesive 83, such as epoxy, the assembly is encapsulated with an elastomer. Application of pressure causes plastic deformation of the loose fitting to bring it into good contact with the substrate 71.

If an epoxy is included, the pressure can squeeze out much of the epoxy, and provide an extremely thin bond layer, as thin as a few nanometers or less. Alternatively, a brazing foil can be used, with a heat treatment occurring, for example, after the CIP process. As discussed for other embodiments, the fitting can then be thinned to a desired thickness. A preferred thickness for many embodiments is less than approximately 125 $\mu$m (0.005").

Variations, modifications, and other implementations of what is described herein will occur to those of ordinary skill in the art without departing from the spirit and the scope of the invention as claimed. Accordingly, the invention is to be defined not by the preceding illustrative description but instead by the spirit and scope of the following claims.

What is claimed is:

1. A device for manipulating microwave radiation, comprising:

a mechanically stable substrate that defines the shape of a surface for reflecting microwave radiation; and a metal fitting conforming to the defined shape, and providing the surface that reflects microwave radiation, wherein the metal fitting has a thickness that is insufficient for independent mechanical stability, wherein the substrate and the metal fitting have a compatible thermal behavior.

2. The device of claim 1, wherein the surface defines at least a portion of a microwave resonant cavity.

3. The device of claim 1, wherein the thickness of the metal fitting is greater than 10 $\mu$m.

4. The device of claim 1, wherein the surface defines at least a portion of a microwave reflector.

5. The device of claim 1, wherein the substrate comprises an insulator.

6. The device of claim 1, wherein the thickness of the metal fitting is less than 500 $\mu$m.

7. The device of claim 6, wherein the thickness of the metal fitting is less than 100 $\mu$m.

8. The device of claim 1, wherein the metal fitting has a ring shape having an inner diameter and an outer diameter.

9. The device of claim 8, wherein the outer diameter is machined to match an inner diameter of the substrate.

10. The device of claim 8, wherein the inner diameter is machined to match an outer diameter of the substrate.

11. The device of claim 1, wherein the metal fitting comprises silver.

12. The device of claim 1, wherein the metal fitting comprises a wrought metal.

13. The device of claim 1, wherein the metal fitting consists of a metal that is at least 99% pure.

14. The device of claim 1, wherein the metal fitting is bonded to the substrate via an interference fit.

15. The device of claim 1, wherein the metal fitting has a machined surface.

16. The device of claim 1, wherein the metal fitting completely shields the substrate from exposure to the microwave radiation.

17. The device of claim 1, further comprising an adhesive layer between the substrate and the metal fitting.

18. The device of claim 17, wherein the adhesive layer has a thickness of less than 1.0 $\mu$m.

19. The device of claim 1, further comprising a braze joint that bonds the metal fitting to the substrate.

20. A device for manipulating microwave radiation, comprising:

a mechanically stable substrate that defines the shape of a surface for reflecting microwave radiation, and has a coefficient of thermal expansion less than $5\times10^{-6}$/° C.; and a metal fitting conforming to the defined shape, and providing the surface that reflects microwave radiation, wherein the metal fitting has a thickness that is insufficient for independent mechanical stability.

21. A device for manipulating microwave radiation, comprising:

a mechanically stable substrate that defines the shape of a surface for reflecting microwave radiation; and a metal fitting conforming to the defined shape, and providing the surface that reflects microwave radiation, wherein the metal fitting has a thickness that is insufficient for independent mechanical stability and has a coefficient of thermal expansion greater than $10\times10^{-6}$/° C.

* * * * *